US011725617B2

(12) United States Patent
Yurumez et al.

(10) Patent No.: US 11,725,617 B2
(45) Date of Patent: Aug. 15, 2023

(54) FLUID DISTRIBUTOR FOR AN INJECTION SYSTEM, IN PARTICULAR A FUEL DISTRIBUTOR RAIL FOR A FUEL INJECTION SYSTEM FOR MIXTURE-COMPRESSING, SPARK-IGNITED INTERNAL COMBUSTION ENGINES

(71) Applicant: Robert Bosch GmbH, Stuttgart (DE)

(72) Inventors: Omercan Yurumez, Nilüfer/Bursa (TR); Cengiz Otuk, Nilüfer/Bursa (TR); Ralf Weber, Bretten (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 17/775,962

(22) PCT Filed: Nov. 17, 2020

(86) PCT No.: PCT/EP2020/082352
§ 371 (c)(1),
(2) Date: May 11, 2022

(87) PCT Pub. No.: WO2021/121824
PCT Pub. Date: Jun. 24, 2021

(65) Prior Publication Data

US 2023/0118352 A1 Apr. 20, 2023

(30) Foreign Application Priority Data

Dec. 20, 2019 (DE) ..... 10 2019 220 372.8

(51) Int. Cl.
*F02M 55/02* (2006.01)
*F02M 61/14* (2006.01)

(52) U.S. Cl.
CPC ..... *F02M 55/025* (2013.01); *F02M 61/14* (2013.01); *F02M 2200/855* (2013.01); *F02M 2200/857* (2013.01)

(58) Field of Classification Search
CPC ..... F02M 55/025; F02M 61/14; F02M 2200/855; F02M 2200/857
(Continued)

(56) References Cited

U.S. PATENT DOCUMENTS

2018/0003203 A1 1/2018 Kochanski et al.

FOREIGN PATENT DOCUMENTS

DE 202014104466 U1 9/2014
DE 102019123673 B3 * 12/2020 ..... F02M 55/02
(Continued)

OTHER PUBLICATIONS

International Search Report for PCT/EP2020/082352, dated Jan. 26, 2021.

*Primary Examiner* — Mahmoud Gimie
(74) *Attorney, Agent, or Firm* — Norton Rose Fulbright US LLP; Gerard Messina

(57) ABSTRACT

A fuel distributor for a fuel injection system for mixture-compressing, spark-ignited internal combustion engines. The fuel distributor rail includes a tubular base body which is processed by forging. At the base body, a first high-pressure output, a second high-pressure output, and a third high-pressure output are provided. The second high-pressure output is situated in an offset manner opposite the first high-pressure output in a first direction along a longitudinal axis of the tubular base body at a predefined distance. The third high-pressure output is situated in an offset manner opposite the second high-pressure output in the first direction along the longitudinal axis at the predefined distance. A first and second holding element, which are used for an at
(Continued)

least indirect fastening of the base body, are situated at the tubular base body.

11 Claims, 3 Drawing Sheets

(58) Field of Classification Search
USPC ..... 123/456
See application file for complete search history.

(56) References Cited

FOREIGN PATENT DOCUMENTS

| | | | | |
|---|---|---|---|---|
| JP | 2006233858 | A | * | 9/2006 |
| JP | 2007146725 | A | * | 6/2007 |
| JP | 2013072430 | A | * | 4/2013 |
| JP | 2018158372 | A | | 10/2018 |

* cited by examiner

FLUID DISTRIBUTOR FOR AN INJECTION SYSTEM, IN PARTICULAR A FUEL DISTRIBUTOR RAIL FOR A FUEL INJECTION SYSTEM FOR MIXTURE-COMPRESSING, SPARK-IGNITED INTERNAL COMBUSTION ENGINES

FIELD

The present invention relates to a fluid distributor for an injection system, in particular a fuel distributor rail for a fuel injection system for mixture-compressing, spark-ignited internal combustion engines, and an injection system. Specifically, the present invention relates to the field of fuel injection systems used for mixture-compressing, spark-ignited internal combustion engines, the fuel distributor rail being situated in an engine compartment of a motor vehicle, for example, fastened at a cylinder head of the internal combustion engine, and being used during operation for directly injecting fuel into the combustion chambers of the internal combustion engine.

BACKGROUND INFORMATION

The abstract and the figures of Japan Patent Application No. JP 2018-158372 A describe and show manufacturing a base body for a distributor rail by forging. In this case, the material is eccentrically forged, so that at the forged base body five connecting elements, which are bored after the forging, and also two holding elements, which have also yet to be bored after the forging, are formed by the forging.

In a base body for a distributor rail, which is manufactured according to the method described and shown in the abstract and the figures of Japan Patent Application No. JP 2018-158372 A, the fastening elements that are formed by forging at the base body and subsequently bored have a high stability, so that the entire distributor rail may be reliably mounted and fastened, for example at a cylinder head in an engine compartment, with the aid of suitable add-on components.

SUMMARY

A fluid distributor according to the present invention and the injection system according to the present invention may have the advantage that an improved design and functionality are possible. In particular, a direct connection of valves to the high-pressure outputs may be made possible.

With the aid of the measures disclosed herein, advantageous refinements of the fluid distributor and the injection system indicated are possible.

The provided injection system may be in particular designed as a fuel injection system that is used to inject a fuel or a mixture including at least one type of fuel. Furthermore, it is possible to use an injection system to not only inject liquid fluids, but also potentially blow in gaseous fluids, in particular combustible gases.

In accordance with an example embodiment of the present invention, the fluid distributor may be advantageously fastened at a suitable body via exactly two holding elements, which is possible directly or indirectly, for example via a suitable holding structure. If the injection system is for example designed as a fuel injection system for motor vehicles, it is generally required that the injection system is fastened in the engine compartment, in particular at a cylinder head, where high stresses occur. In this case, the term "holding element" thus refers to the elements of the fluid distributor, which may be accordingly subjected to stress and at which the at least one indirect fastening of the fluid distributor takes place at a suitable body, in particular a cylinder head.

Here, it may thus be differentiated between a (high strength) holding element and, if provided, at least one fastening element that is only used for minor stresses and that is used to fasten a cable harness, for example. The holding elements must usually withstand very high stresses. When the holding elements are formed at the tubular base body in a forged manner, as is preferred, an essential material use must thus be generally taken into account in this case.

In principle, it is also possible, however, that a soldered design is implemented, in the case of which the holding elements are connected to the tubular base body by soldering.

In the case of a forged design, the material is cut to length from a round stock, for example, for manufacturing the tubular base body and preferably also the holding elements and high-pressure outputs forged concurrently at same. The amount of the material then results with a certain tolerance. The material cut to length is inserted into a press that may include a bottom half of the die and a top half of the die. The halves of the die provide a contour for the forging process that defines the forged shape of the base body. The contour must also be filled to 100% at the lower tolerance end during forging. Since the contour for the base body is locally varied and may provide eccentricities or a local increased demand for the material, for example, a locally varied amount of the material generally results, which is displaced between the halves of the die into a gap used for receiving displaced material. This makes it possible for the forging contour to be reliably achieved in one or several forging stages. Here, a use of high-quality materials, in particular high-quality steels, is advantageous. To design the base body, the high-pressure outputs, and the holding elements, a stainless steel is preferably used, a one-piece design preferably taking place by forging.

The holding elements of the fluid distributor counteract during operation the reaction forces of the valves that develop as a result of the hydraulic pressure and may thus advantageously prevent a deflection of the tubular base body; specifically, reaction forces, which are directed from the cylinder head to the fluid distributor, may occur as a result of the valves being supported on a cylinder head. In this way, movements of the valves are reduced in relation to the high-pressure outputs. This, in turn, reduces the stresses that act on the seals between the valves and the high-pressure outputs. In particular, wear and tear of the sealing rings or the like is prevented. Appropriate support of the fluid distributor on a cylinder head is necessary, however, to not excessively stress the screws, for example, that fasten the tubular base body of the fluid distributor at the cylinder head.

With the aid of a provided design in accordance with an example embodiment of the present invention, it may be achieved in particular that these requirements may be met at three high-pressure outputs having only two holding elements. In this case, the arrangement of the holding elements at the tubular base body is essential. In particular, the arrangement of the holding elements at the tubular base body also influences the natural frequency of the fluid distributor, and the holding elements as well as the relevant fastening must reliably hold the fluid distributor in position at a cylinder head, for example, under vibration stresses.

Advantageous orientations or arrangements are possible as disclosed herein. The holding elements are preferably situated as closely as possible at the longitudinal axis of the tubular base body, as disclosed herein.

With the aid of one advantageous embodiment, further optimization is possible. In particular, a comparable stress at the seals, in particular O sealing rings, may thus be achieved at the individual high-pressure outputs in order to prevent one of these seals from being subjected to excessive stress. The positioning of the holding elements as a function of the provided boundary conditions, in particular geometric parameters, may be advantageously determined with the aid of a simulation. One essential parameter is in this case the provided distance that is for example predefined by a cylinder distance in an internal combustion engine having three cylinders. Particularly advantageous arrangements of the holding elements may be implemented as disclosed herein. One advantageous embodiment of the fluid distributor, in which a one-piece design in particular takes place by forging, is disclosed herein. The advantageous embodiment disclosed herein is suitable in particular for gasoline engines or for gasoline injections and gasoline mixtures.

In the case of one possible design, the high-pressure outputs are designed as radial high-pressure outputs at the tubular base body. The tubular base body is preferably formed from a corrosion-resistant stainless steel, in particular from a stainless steel having the material number 1.4301, 1.4307, 1.4462, or 1.4362.

BRIEF DESCRIPTION OF THE DRAWINGS

Preferred exemplary embodiments of the present invention are explained in greater detail in the following description with reference to the figures in which corresponding elements are provided with matching reference numerals.

DETAILED DESCRIPTION OF EXAMPLE EMBODIMENTS

Figure 1:
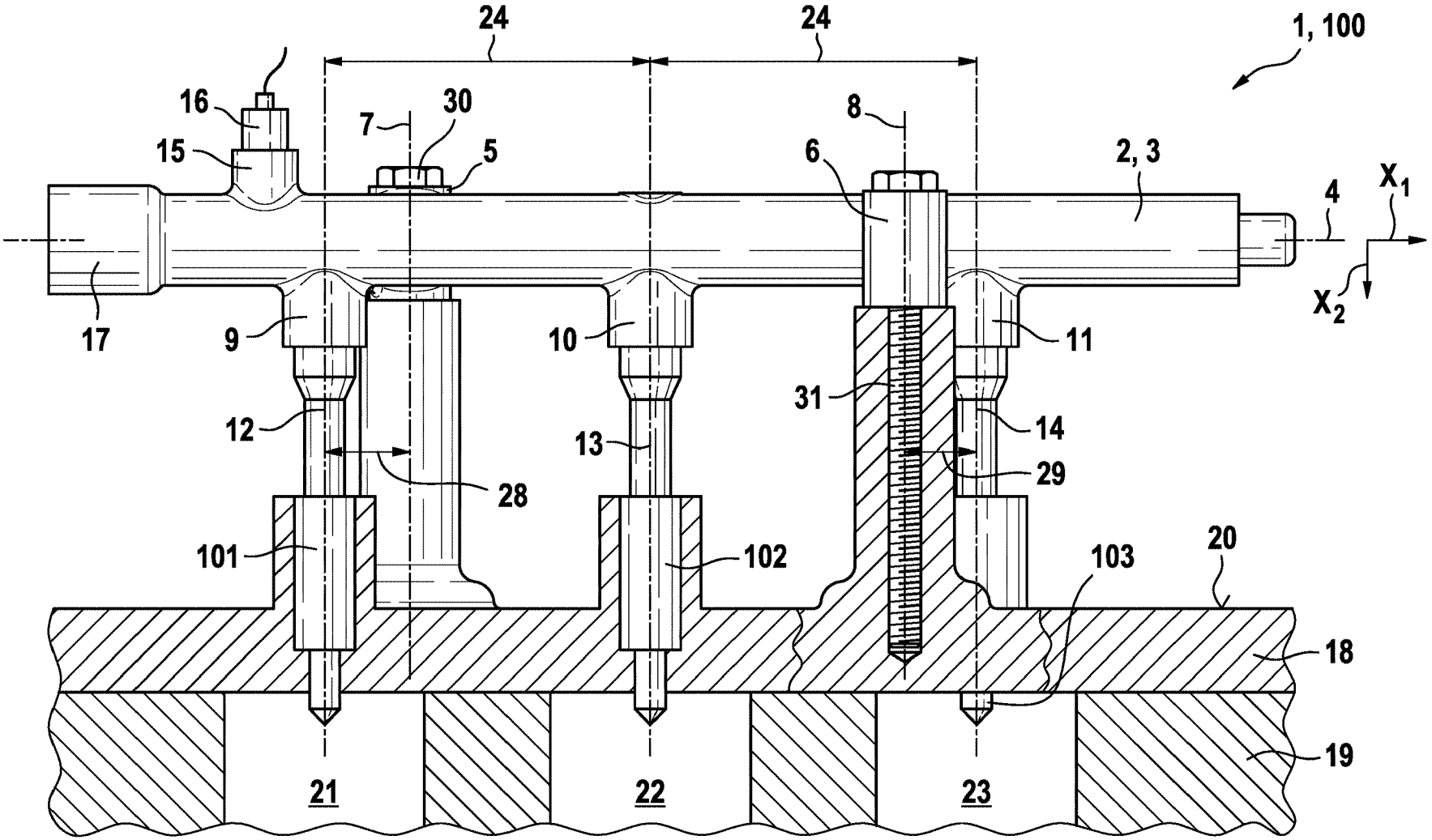
FIG. 1 shows an extract from a schematic illustration of an injection system, designed as a fuel injection system, including a fluid distributor, designed as a fuel distributor rail, according to one exemplary embodiment of the present invention.

Possible designs of an injection system 100 and a fluid distributor 1 for an injection system 100 are described based on the figures. Specifically, such a fluid distributor 1 may be designed as a fuel distributor rail 1 and used for a fuel injection system 100, in which a fluid is distributed to preferably several valves (injectors) 101 through 103, in particular fuel injectors 101 through 103. In this case, fluid distributor 1 is preferably designed in such a way that a very high stability is guaranteed with regard to a pressure of the fluid that is stored within fluid distributor 1 and distributed to fuel injectors 101 through 103, for example. Fluid distributor 1 is preferably implemented as a forged fluid distributor 1, so that high stresses are possible with regard to the pressure of the fluid. For this reason, a fluid distributor 1 is contemplated, whose tubular base body 2 is forged. It is possible that fluid distributor 1 also has at least one further component that is screwed to base body 2 or connected by welding or soldering, for example.

Figure 2:
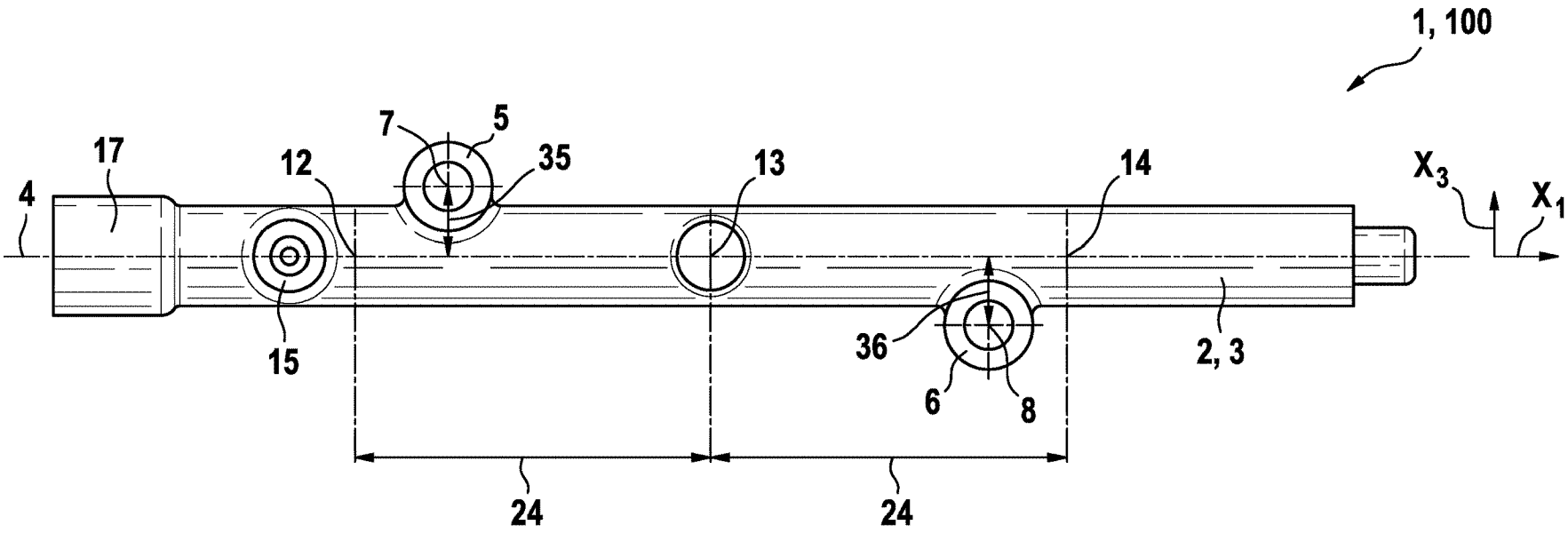
FIG. 2 shows an extract from a schematic illustration of the fluid distributor illustrated in FIG. 1 in the viewing direction, identified with $X_2$, according to the exemplary embodiment of the present invention.
Figure 3:
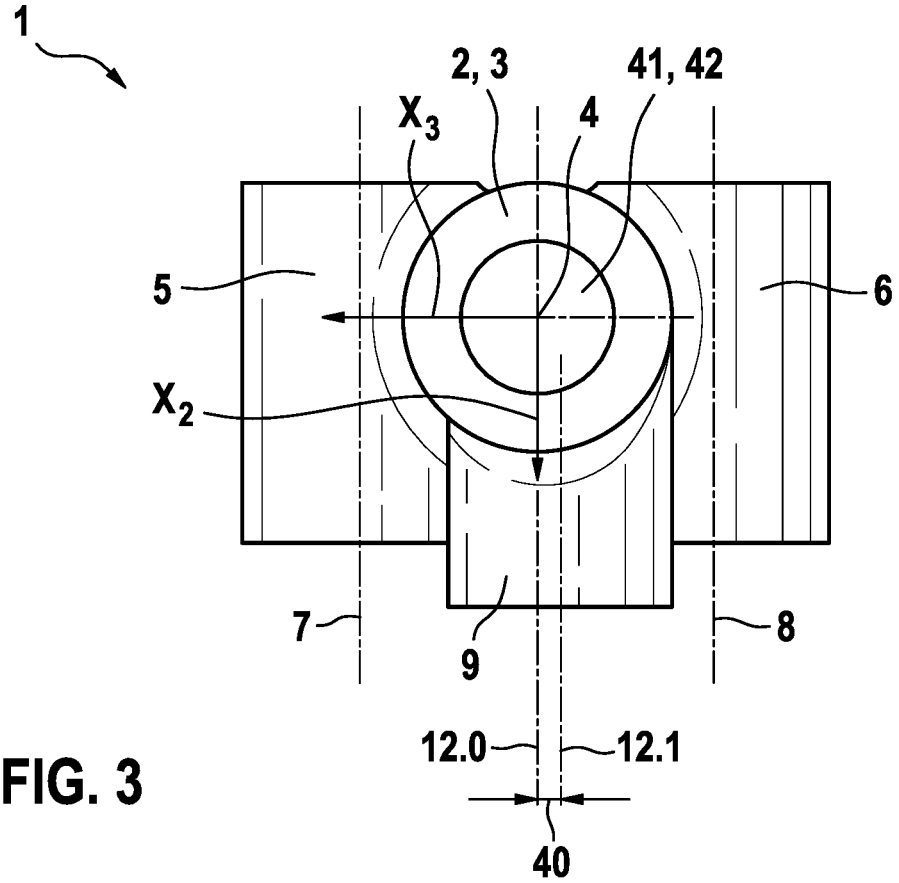
FIG. 3 shows the fluid distributor illustrated in FIG. 1 from the viewing direction, identified with $X_1$, according to a modified design, in accordance with the present invention.

FIG. 1 shows a schematic illustration of an injection system 100, designed as a fuel injection system 100, including a fluid distributor 1, designed as a fuel distributor rail 1, according to one exemplary embodiment of the present invention. FIG. 2 shows fluid distributor 1 from the viewing direction identified with $X_2$ in FIG. 1. For forging, the desired shape of base body 2 may be predefined in a complex manner. In this exemplary embodiment, tubular base body 2 includes a tubular part 3 that, for forming an interior 41, is also provided with a longitudinal bore 42 along a longitudinal axis 4, as illustrated in FIG. 3. Furthermore, base body 2 includes holding elements 5, 6 that are forged in this case as eccentricities. In this exemplary embodiment, axes 7, 8 of holding elements 5, 6 are spaced apart from longitudinal axis 4.

In this exemplary embodiment, high-pressure outputs 9 through 11, which are designed as cups 9 through 11, are also forged at base body 2 for connecting fuel injectors 101 through 103. In this exemplary embodiment, axes 12 through 14 of high-pressure outputs 9 through 11 intersect longitudinal axis 4, as is illustrated in FIG. 3 by an axis 12.0 for high-pressure output 9.

Furthermore, at least one connecting piece 15, which may be used for example for connecting a pressure sensor 16, is designed at the base body by forging. An axial high-pressure input 17 is also designed at tubular part 3.

Directions $X_1$, $X_2$, $X_3$ may be established according to a right-hand system (right-handed system of three coordinates) to describe the design. Direction $X_1$ is oriented in this case along longitudinal axis 4. Direction $X_2$ is directed from longitudinal axis 4 of tubular base body 2 to a cylinder head 18 of an internal combustion engine 19, when fluid distributor 1 is mounted. In this exemplary embodiment, axes 7, 8 of holding elements 5, 6 as well as axes 12 through 14 of high-pressure outputs 9 through 11 are oriented in parallel to one another and along direction $X_2$. By establishing directions $X_1$ and $X_2$, the orientation of direction $X_3$ results that is thus in parallel to a top side 20 of cylinder head 18, when fluid distributor 1 is mounted. The fastening of fluid distributor 1 at cylinder head 18 is schematically illustrated by fastening elements (screws) 30, 31 that act at one of holding elements 5, 6 in each case and are oriented along axes 7, 8.

Internal combustion engine 19 includes three cylinders 21 through 23. In this way, a distance 24 between axis 12 of high-pressure output 9 and axis 13 of high-pressure output 10 or between axis 13 of high-pressure output 10 and axis 14 of high-pressure output 11 is predefined that is a cylinder distance 24 in this exemplary embodiment.

In the mounted state, valves 101 through 103 are supported at cylinder head 18 in direction $X_2$ in this exemplary embodiment. In this exemplary embodiment, reaction forces occur during operation, in particular as a result of the hydraulic pressure, which act on valves 101 through 103 opposite to direction $X_2$, so that elastic deformations of tubular base body 2 with regard to longitudinal axis 4 occur. Specifically, shifts of high-pressure outputs 9 through 11 in and opposite to direction $X_2$ may result in this case which stress corresponding sealing points to valves 101 through 103.

The two holding elements 5, 6 are situated at tubular base body 2 in such a way that sufficient fastening is possible with the aid of only two holding elements 5, 6, without subjecting the seals to excessive stress. Essential in this case, in addition to the orientation of axes 7, 8 of holding elements 5, 6 along direction $X_2$, is the positioning along longitudinal axis 4 of tubular base body 2.

In this exemplary embodiment, a first distance 28 results between axis 12 of high-pressure output 9 and axis 7 of holding element 5, viewed along longitudinal axis 4. Accordingly, a second distance 29 results between axis 14 of high-pressure output 11 and axis 8 of holding element 6. In a modified design, it is also possible that at least one of distances 28, 29 at least essentially disappears, so that axis 7 is at least essentially in contact with axis 12 and/or axis 8 is at least essentially in contact with axis 14, viewed along longitudinal axis 4.

In this exemplary embodiment, first distance 28 and second distance 29 are, however, predefined as greater than zero. In this case, axis 7 of holding element 5 is always in direction $X_1$, viewed from axis 12 of high-pressure output 9, while axis 8 of holding element 6 is always opposite to direction $X_1$, viewed from axis 14 of high-pressure output 11. First distance 28 is in this case maximally 0.5 times greater than predefined distance (cylinder distance) 24. Furthermore, second distance 29 is also maximally 0.5 times greater than predefined distance 24. First distance 28 and second distance 29 are not necessarily selected to be of equal size. Preferably, first distance 28 and/or second distance 29 is/are predefined having a positive value in each case, in particular a value that is at least 0.1 times greater than predefined distance 24 being predefined in each case. Furthermore, first distance 28 and/or second distance 29 is/are preferably predefined having a value in each case that is maximally 0.3 times greater than predefined distance 24.

Further parameters for the possible arrangement of holding elements 5, 6 result along direction $X_3$. Preferably, holding elements 5, 6 or axes 7, 8 are situated on different sides of longitudinal axis 4 with regard to direction $X_3$. Furthermore, distances 35, 36 between axis 7 and longitudinal axis 4 or axis 8 and longitudinal axis 4 are preferably minimized with regard to at least one required wall thickness, in particular a wall thickness of tubular base body 2.

Axes 7, 8 of holding elements 5, 6 are preferably positioned along longitudinal axis 4 in such a way that the deformations of tubular base body 2 that occur during operation result in evened-out, in particular in terms of magnitude at least approximately equal maximal shifts of high-pressure outputs 9 through 11 in and opposite to direction $X_2$. This results in comparable stresses at the sealing points to valves 101 through 103. In contrast to a design in which such an evening-out does not take place, the evened-out stress is then lower than the maximum individual stress.

The design selected in the concrete individual case may, however, also be established with reference to further boundary conditions. It is in particular also advantageous to positively predefine distances 28, 29 in order to avoid mass accumulations along longitudinal axis 4, which has a positive effect on the required use of material during forging. Furthermore, the design of tubular base body 2 does not necessarily have to be symmetrical. For example, one of distances 28, 29 may also be 0.3 times greater than predefined distance 24, while the other distance may be 0.2 times greater than predefined distance 24. In this way, eccentrically situated high-pressure outputs 9 through 11 are compensated for, for example, the axes 12 through 14 of which are thus offset by an axis offset (radial cup offset) 40 with regard to longitudinal axis 4 in relation to direction $X_3$, as illustrated in FIG. 3 by way of example.

If such a positive (i.e., different from zero) axis offset 40 is provided, as illustrated in FIG. 3, it may be oriented in or opposite to direction $X_3$, viewed from longitudinal axis 4. Starting from an arrangement of holding elements 5, 6, as illustrated in FIGS. 1 and 2, this axis offset 40, i.e., viewed from longitudinal axis 4, is oriented opposite to direction $X_3$ for a possible, modified design illustrated here having a positive axis offset 40. For illustration purposes, axis 12 is identified by 12.0 in the case of a disappearing axis offset 40 and axis 12 is correspondingly identified by 12.1 in the case of a positive axis offset 40 in FIG. 3.

Longitudinal axis 4 and/or axes 7, 8 of holding elements 5, 6 and/or axes 12 through 14 of high-pressure outputs 9 through 11 may be in particular determined as boring axes of suitable bores.

As a result of the smaller number of holding elements 5, 6 compared to a conventional design, i.e., only two holding elements 5, 6 in the case of three cylinders, fluid distributor 1 requires less installation space and may be implemented more easily. The lesser material use may result in an essential reduction in the manufacturing costs. On the one hand, the amount of the required rod material may be reduced. On the other hand, process energy for heating the rod to the forging temperature may in particular be saved in the case of a forged design.

The present invention is not limited to the described exemplary embodiments.

What is claimed is:

1. A fluid distributor for an injection system, comprising:
a tubular base body which is processed by forging in one or multiple stages;
a first high-pressure output, a second high-pressure output, and a third high-pressure output provided at the base body, the second high-pressure output being situated in an offset manner opposite the first high-pressure output in a first direction along a longitudinal axis of the tubular base body at a predefined distance, the third high-pressure output being situated in an offset manner opposite the second high-pressure output in the first direction along the longitudinal axis at the predefined distance; and
a first holding element and a second holding element, which are used for an at least indirect fastening of the base body, provided at the base body, the first holding element and the second holding element being situated at the tubular base body in such a way that, viewed along the longitudinal axis, an axis of the first holding element is positioned in the first direction at a distance that is maximally 0.5 times greater than the predefined distance from an axis of the first high-pressure output, and, viewed along the longitudinal axis, an axis of the second holding element is positioned opposite to the first direction at a distance that is maximally 0.5 times greater than the predefined distance from an axis of the third high-pressure output.

2. The fluid distributor as recited in claim 1, wherein the fluid distributor is a fuel distributor rail for a fuel injection system for an mixture-compressing, spark-ignited internal combustion engine.

3. The fluid distributor as recited in claim 1, wherein the axis of the first high-pressure output, an axis of the second high-pressure output, the axis of the third high-pressure output, the axis of the first holding element, and the axis of the second holding element, are oriented along a second direction that is perpendicular to the first direction.

4. The fluid distributor as recited in claim 3, wherein a third direction is perpendicular to the first direction as well as perpendicular to the second direction, and the axis of the first holding element and the axis of the second holding element, viewed along the third direction, are positioned in and opposite to or opposite to and in the third direction with regard to the longitudinal axis.

5. The fluid distributor as recited in claim 4, wherein a distance between the axis of the first holding element and the longitudinal axis is minimized along the third direction with regard to at least one required wall thickness and/or a distance between the axis of the second holding element and the longitudinal axis is minimized along the third direction with regard to at least one required wall thickness.

6. The fluid distributor as recited in claim 3, wherein the axis of the first holding element and the axis of the second holding element are positioned along the longitudinal axis in such a way that deformations of the tubular base body that occur during operation result in evened-out, in terms of magnitude at least approximately equal maximal shifts of the first high-pressure output, of the second high-pressure output, and of the third high-pressure output in and opposite to the second direction in each case.

7. The fluid distributor as recited in claim 1, wherein the first holding element and the second holding element are situated at the tubular base body in such a way that, viewed along the longitudinal axis, the axis of the first holding element is positioned at a distance that is maximally 0.3 times greater than the predefined distance from an axis of the first high-pressure output in the first direction and/or, viewed along the longitudinal axis, the axis of the second holding element is positioned at a distance that is maximally 0.3 times greater than the predefined distance from the axis of the third high-pressure output opposite to the first direction.

8. The fluid distributor as recited in claim 1, wherein the first holding element and the second holding element are situated at the tubular base body in such a way that, viewed along the longitudinal axis, the axis of the first holding element is positioned at a distance that is at least 0.1 times greater than the predefined distance from an axis of the first high-pressure output in the first direction, and/or the axis of the second holding element is positioned at a distance that is at least 0.1 times greater than the predefined distance from an axis of the third high-pressure output opposite to the first direction.

9. The fluid distributor as recited in claim 1, wherein the first holding element and the second holding element are processed by forging in one or multiple stages together with the tubular base body, and/or the first high-pressure output, the second high-pressure output, and the third high-pressure output are processed by forging in one or multiple stages together with the tubular base body.

10. The fluid distributor as recited in claim 1, wherein: (i) at least the tubular base body is formed from a corrosion-resistant stainless steel having a material number 1.4301, 1.4307, 1.4462 or 1.4362, and/or (ii) the tubular base body together with at least the first high-pressure output, the second high-pressure output, and the third high-pressure output and/or the first holding element and the second holding element is formed from a stainless steel, and/or (iii) with the first holding element and the second holding element, exactly two holding elements are provided at the tubular base body that are used for an at least indirect fastening at a cylinder head, and/or (iv) with the first high-pressure output, the second high-pressure output, and the third high-pressure output, exactly three high-pressure outputs are provided at the tubular base body that are used for a direct connection of the valves.

11. A fuel injection system for a mixture-compressing, spark-ignited internal combustion engine, comprising:

a fuel distributor rail including:

a tubular base body which is processed by forging in one or multiple stages;

a first high-pressure output, a second high-pressure output, and a third high-pressure output provided at the base body, the second high-pressure output being situated in an offset manner opposite the first high-pressure output in a first direction along a longitudinal axis of the tubular base body at a predefined distance, the third high-pressure output being situated in an offset manner opposite the second high-pressure output in the first direction along the longitudinal axis at the predefined distance; and a first holding element and a second holding element, which are used for an at least indirect fastening of the base body, provided at the base body, the first holding element and the second holding element being situated at the tubular base body in such a way that, viewed along the longitudinal axis, an axis of the first holding element is positioned in the first direction at a distance that is maximally 0.5 times greater than the predefined distance from an axis of the first high-pressure output, and, viewed along the longitudinal axis, an axis of the second holding element is positioned opposite to the first direction at a distance that is maximally 0.5 times greater than the predefined distance from an axis of the third high-pressure output.

* * * * *